US011992043B2

(12) United States Patent
Liu

(10) Patent No.: US 11,992,043 B2
(45) Date of Patent: May 28, 2024

(54) ELECTRONIC CIGARETTE

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 332 days.

(21) Appl. No.: 17/506,629

(22) Filed: Oct. 20, 2021

(65) Prior Publication Data

US 2022/0273030 A1 Sep. 1, 2022

(30) Foreign Application Priority Data

Mar. 1, 2021 (CN) ..... 202110225433.7
Mar. 1, 2021 (CN) ..... 202120439858.3

(51) Int. Cl.

| | |
|---|---|
| ***A24F 40/30*** | (2020.01) |
| ***A24F 40/10*** | (2020.01) |
| ***A24F 40/42*** | (2020.01) |
| ***A24F 40/485*** | (2020.01) |
| ***A24F 40/57*** | (2020.01) |
| ***A24F 40/60*** | (2020.01) |

(52) U.S. Cl.

CPC ..... *A24F 40/30* (2020.01); *A24F 40/10* (2020.01); *A24F 40/42* (2020.01); *A24F 40/485* (2020.01); *A24F 40/57* (2020.01); *A24F 40/60* (2020.01)

(58) Field of Classification Search

CPC ..... A24F 40/30; A24F 40/60; A24F 40/485
See application file for complete search history.

(56) References Cited

U.S. PATENT DOCUMENTS

| | | | | |
|---|---|---|---|---|
| 2017/0095004 | A1* | 4/2017 | Liu | H05B 1/0244 |
| 2020/0037667 | A1 | 2/2020 | Woodcock | |
| 2020/0163382 | A1* | 5/2020 | Trzecieski | A24F 40/46 |

FOREIGN PATENT DOCUMENTS

| | | | | |
|---|---|---|---|---|
| CN | 209898295 U | * | 1/2020 | A24F 47/00 |
| CN | 111920097 A | * | 11/2020 | |
| CN | 111920097 A | | 11/2020 | |
| WO | WO-2020225105 A1 | * | 11/2020 | A24F 40/40 |

OTHER PUBLICATIONS

CN209898295U English translation obtained from Espacenet Apr. 1, 2024 (Year: 2024).*

* cited by examiner

*Primary Examiner* — Philip Y Louie
*Assistant Examiner* — Eric M Fierce
(74) *Attorney, Agent, or Firm* — MATTHIAS SCHOLL P.C.; Matthias Scholl

(57) ABSTRACT

An electronic cigarette includes a main body, a control assembly, at least two clearomizers, and a sliding member. The at least two clearomizers and the sliding member are disposed on the main body. The sliding member is slidable on the main body to drive the control assembly to control the operation of the at least two clearomizers.

6 Claims, 4 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 202110225433.7 filed Mar. 1, 2021, and to Chinese Patent Application No. 202120439858.3 filed Mar. 1, 2021. The contents of all of the aforementioned applications, including any intervening amendments thereto, are incorporated herein by reference.

BACKGROUND

The disclosure relates to an electronic cigarette.

Conventional electronic cigarettes including at least two clearomizers are provided with a plurality of buttons to control the output of various circuits connected to the clearomizers, thereby controlling the clearomizers to work independently or simultaneously. However, the plurality of buttons and circuits make the electronic cigarettes complex, and one or two of the buttons may be pressed by mistake, leading to unexpected activation of the clearomizers. This brings bad user experience.

SUMMARY

The disclosure provides an electronic cigarette comprising a main body and a control assembly, at least two clearomizers, and a sliding member; the at least two clearomizers and the sliding member are disposed on the main body; the sliding member is slidable on the main body to drive the control assembly to control an operation of the at least two clearomizers.

In a class of this embodiment, each of the at least two clearomizers comprises an air hole; and the main body comprises at least one air inlet communicating with the air hole.

In a class of this embodiment, the at least one air inlet is disposed in a sliding direction of travel of the sliding member; the sliding member is configured to slide to cover and/or expose the at least one air inlet.

In a class of this embodiment, the sliding member is slidable with respect to the main body to cause the control assembly to change a potential difference of an output circuit, thereby controlling the operation of the at least two clearomizers.

In a class of this embodiment, the control assembly comprises at least one magnetic member and a plurality of semiconductor switches corresponding to the at least two clearomizers respectively.

In a class of this embodiment, the control assembly further comprises a control board; the at least one magnetic member is disposed on the sliding member in the sliding direction of travel of the sliding member; the plurality of semiconductor switches is disposed on the control board and abuts against the sliding member; when the at least one magnetic member moves to a position to match a semiconductor switch, a potential difference of the semiconductor switch is changed.

In a class of this embodiment, the main body further comprises a first housing comprising a plurality of chambers configured to accommodate the at least two clearomizers respectively.

In a class of this embodiment, the first housing comprises a sliding groove; the sliding member is disposed in the sliding groove to slide back and forth within the sliding groove; the at least one air inlet is disposed on a wall of the sliding groove.

In a class of this embodiment, the main body further comprises a second housing disposed outside of the first housing; the second housing comprises a through hole matched with the sliding groove; the sliding member is disposed through the through hole or a slide switch is disposed in the through hole to connect to the sliding member.

In a class of this embodiment, each of the at least two clearomizers comprises an airflow channel, and the control assembly further comprises a pneumatic switch disposed in the airflow channel or in the air hole.

In a class of this embodiment, each of the at least two clearomizers comprises an electrical heating element, and resistances of electrical heating elements of the at least two clearomizers are different from each other.

In a class of this embodiment, a mouthpiece is disposed on the main body and communicates with each of the at least two clearomizers.

In a class of this embodiment, the mouthpiece is detachably connected to the main body and the at least two clearomizers are detachably disposed in the main body.

The following advantages are associated with the electronic cigarette of the disclosure: the electronic cigarette comprises the sliding member which is configured to indirectly control the clearomizers to work independently or together, thus avoiding the complicated structure of conventional electronic cigarettes with a plurality of buttons, preventing the unexpected activation of the clearomizer by mistake, and improving the user experience.

Figure 1:
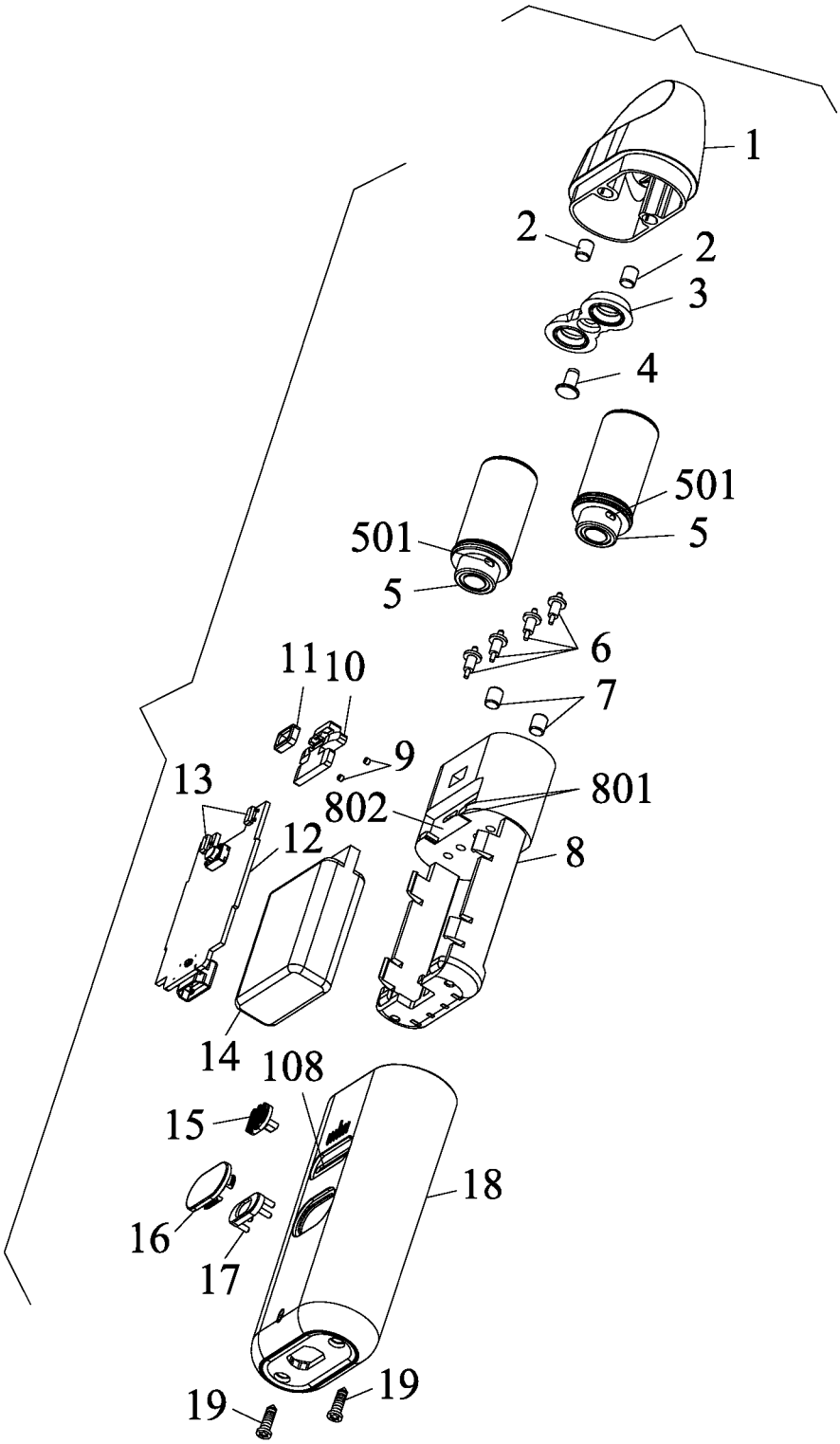
FIG. 1 is an exploded view of an electronic cigarette according to one embodiment of the disclosure.

In the drawings, the following reference numbers are used: 1. Mouthpiece; 2. First magnet; 3. First silicone seal; 4. Pin; 5. Clearomizer; 6. Electrode; 7. Second magnet; 8. First housing; 9. Magnetic member; 10. Sliding member; 11. Second silicone seal; 12. Control board; 13. Semiconductor switch; 14. Battery; 15. Slide switch; 16. First power button; 17. Third silicone seal; 18. Second housing; 19. Screw; 108. Through hole; 501. Air hole; 801. Air inlet; and 802. Sliding groove.

DETAILED DESCRIPTION

To further illustrate, embodiments detailing an electronic cigarette are described below. It should be noted that the following embodiments are intended to describe and not to limit the disclosure.

An electronic cigarette of the disclosure comprises a main body, a control assembly, at least two clearomizers 5, and a sliding member 10. The at least two clearomizers 5 and the sliding member 10 are disposed on the main body. The sliding member is slidable on the main body, causing the control assembly to control operation of the at least two clearomizers 5. The term "clearomizer" as used herein refers to, but is not limited to an atomizer. The number of the clearomizers 5 is determined by the demand. Preferably, a first clearomizer 5 is disposed one a first side of the main body and a second clearomizer 5 disposed on a second side of the main body; when the sliding member 10 moves to the first side of the main body, the first clearomizer 5 starts or stops working and the second clearomizer 5 stops or starts working; when the sliding member 10 moves to the second side of the main body, the second clearomizer 5 starts or stops working and the first clearomizer 5 stops or starts working; when the sliding member 10 moves to a middle position between the first clearomizer 5 and the second clearomizer 5, the two clearomizers 5 start or stop working simultaneously. When the electronic cigarette comprises three clearomizers and a neutral position disposed on both ends of the sliding groove; two of the three clearomizers are moved with the sliding member 10 at the same time, so that the sliding member can simultaneously control the two clearomizers; the sliding member 10 is moved to the neutral position to control the one clearomizer 5. The electronic cigarette may comprise more than three clearomizers using the same principle herein disclosed, and hence are not discussed in detail herein.

The movement of the sliding member includes, but is not limited to, linear movements and can be arc, circular, curve, and back and forth movements. The sliding member is in a shape of a strip, a fan, etc.

Each of the at least two clearomizers 5 comprises an airflow channel and an air hole 501. The main body further comprises at least one air inlet 801 communicating with the corresponding air hole 501. The at least one air inlet 801 is disposed in the sliding direction of travel of the sliding member 10. The at least one air inlet 801 is covered and/or exposed by sliding the sliding member 10 with respect to the main body. To say that the at least one air inlet 801 is "covered and/or exposed" means that the at least one air inlet 801 is fully or partially covered and/or exposed with the sliding member 10. In certain embodiments, the main body comprises only one air inlet 801 communicating with a plurality of air holes 501. In certain embodiments, the main body comprises at least two air inlets 801 each communicating with the corresponding air hole 501. The coverage area of the air inlet 801 is adjusted by sliding the sliding member 10 with respect to the main body, thereby allowing the user to control the amount of the smoke generated from the at least two clearomizers 5.

A mouthpiece 1 is disposed on the main body and communicates with each of the at least two clearomizers 5, so that multiple flavors of the smoke from different clearomizers can be inhaled by a user at the same time through the mouthpiece 1.

The mouthpiece 1 is detachably connected to the main body through a connection piece and the at least two clearomizers 5 are detachably disposed in the main body. The connection piece includes, but is not limited to, a screw thread, an interference fit part, a snap fastener, a magnet, a sticking material, and a pluggable member. The mouthpiece 1 is detachable from the main body for convenient assembly and disassembly of the at least two clearomizers 5. In certain conventional electronic cigarettes, two clearomizers are secured within the atomizer, as a result, there arise disadvantages, such as a complex structure, inconvenient assembly, non-detachable clearomizer, and non-reusable resource.

The electronic cigarette further comprises an electrical heating element disposed in each of the at least two clearomizers 5. Each electrical heating element possesses a resistance of a different value so as to heat different types of e-liquids.

The control assembly comprises a control board 12.

In certain embodiments, the control assembly further comprises at least one magnetic member 9 and a semiconductor switch 13 corresponding to each of the at least two clearomizers 5. The semiconductor switch 13 may be a Hall-effect switch. The magnetic member 9 may comprise a magnetic material or a Co alloy, such as, but not limited to, a magnet, Co—Ni—P alloy, Fe—Ni—Co alloy, and Co—P alloy.

In certain embodiments, the control assembly further comprises a pneumatic switch disposed in each of the airflow channels or the air holes.

Example 1

Figure 2:
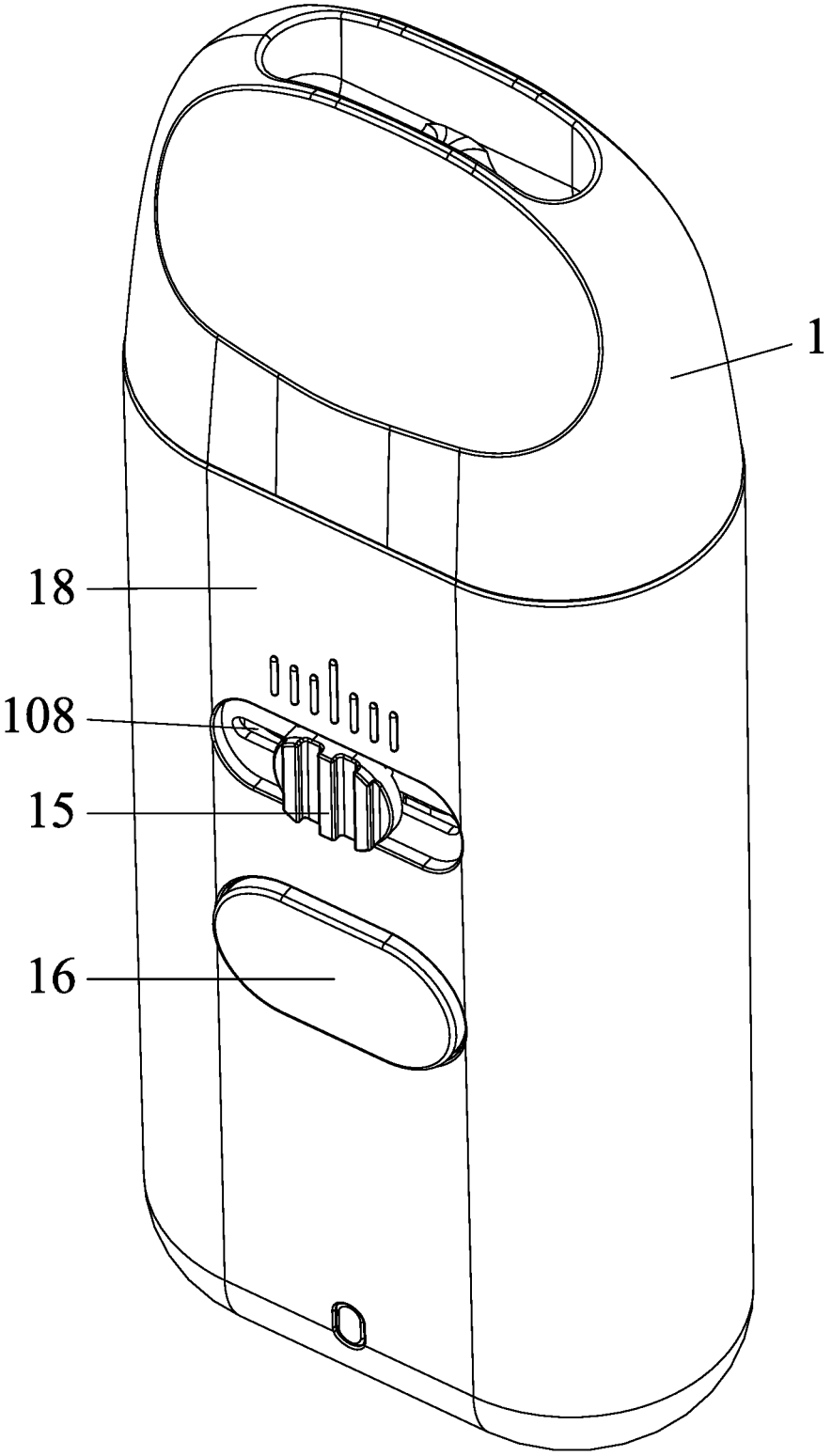
FIG. 2 is a perspective view of an electronic cigarette according to one embodiment of the disclosure.
Figure 3:
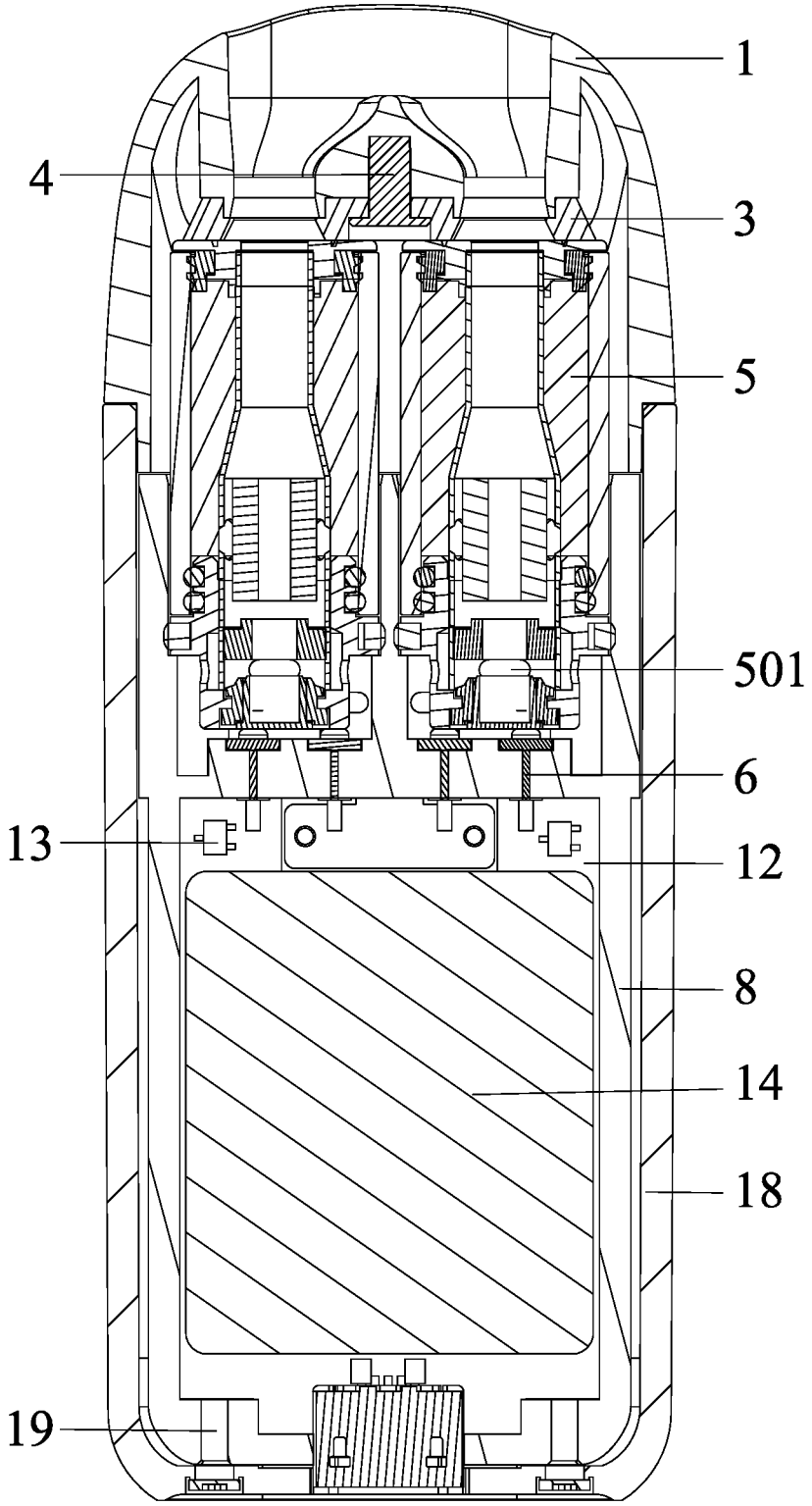
FIG. 3 is a cross-sectional view of an electronic cigarette according to one embodiment of the disclosure.

Referring to FIGS. 1-3, an electronic cigarette comprises a mouthpiece 1, two first magnets 2, a first silicone seal 3, a pin 4, two clearomizers 5, two pairs of electrodes 6, two second magnets 7, a first housing 8, two magnetic members 9, a sliding member 10, a second silicone seal 11, a control board 12, two semiconductor switch 13, a battery 14, a slide switch 15, a first power button 16, a third silicone seal 17, a second housing 18, and a plurality of screws 19. The first housing 8 comprises two chambers to accommodate the two corresponding clearomizer 5. Each of the two chambers comprises a bottom surface embedded with a pair of electrodes 6, so that the two clearomizer 5 are separately connected to the two pairs of electrodes for conducting electricity. Each of the two clearomizers 5 comprises an air hole 501. An output terminal of the battery 14 is connected to an input terminal of the control board 12 for the supply of power to the control board. The battery 14 and the control board 14 are disposed in the first housing 8. The two semiconductor switches 3 are disposed on both sides of a first end of the control board 12 to control operation of the two clearomizers 5. The first housing comprises a sliding groove 802 and two air inlets 801 disposed on both ends of the inside of the sliding groove 802. The air inlets 801 are configured to allow air to enter the first housing 8. Corresponding the two air inlets 801 and the two air holes 501 communicate with each other. The two magnetic members 9 are secured on both sides of a bottom surface of the sliding member 10. The sliding member 10 is disposed in the sliding groove 802 to slide back and forth relative to the main body 802. The two semiconductor switches 13 are disposed below the sides of the two magnetic members 9. The second silicone seal 11 is disposed on the sliding member 10 to seal a gap between the sliding member 10 and the sliding groove 802. The first housing 8 is secured to a bottom surface of the inside of the second housing 18 by the plurality of screws 19. The second housing 18 comprises a through hole 108 disposed directly opposite of the two air inlets and communicating with the two air inlets. The first end of the slide switch 15 is inserted into the sliding member 10 through the through hole 108. The third silicone seal 17 is disposed on the first power button 16 and is inserted through a hole of the second housing 18. The first power button 16 is disposed on a second power button of the control board 12, so that the control board is turned on by pressing the first power button 16. The first silicone seal 3 is secured to a top portion of the inside of the mouthpiece 1 by a pin 4, thereby creating a seal for an inner passage of the mouthpiece 1. The two first magnets 2 are disposed on both sides of a bottom surface of the mouthpiece 1. The two second magnets 7 are disposed on both sides of a top surface of the outside of the first housing 8. The mouthpiece 1 is connected to the top surface of the first housing 8 by magnetic attraction between the two first magnets 2 and the two second magnets. The upper part of each of the two clearomizers 5 are disposed in the mouthpiece 1.

The working principle of the electronic cigarette is detained as follows: when the slide switch 15 is moved to the left, the sliding member 10 moves to a left side of the sliding groove 802 as well, keeping the left magnetic member 9 above the left semiconductor switch 13; subsequently, the magnetism of the left magnetic member 9 leads to a change in the potential difference of the left semiconductor switch 13, so that the left semiconductor switch 13 is turned off; thereby, the clearomizer 5 in the right chamber operates alone; when the slide switch 15 is moved to the right, the sliding member 10 moves to a right side of the sliding groove 802 as well, keeping the right magnetic member 9 above the right semiconductor switch 13; subsequently, the magnetism of the right magnetic member 9 leads to a change in the potential difference of the right semiconductor switch 13, so that the right semiconductor switch 13 is turned off; thereby, the clearomizer 5 in the left chamber operates alone; when the slide switch 15 is moved to a middle position of the sliding groove 802, the potentials of the two semiconductor switches 13 are balanced with each other, enabling the two clearomizers 5 to work together. In addition, when the sliding member 10 moves left and right with the slide switch 15, the coverage area of the two air inlets 801 is adjusted to control the amount of the smoke generated from the two clearomizers 5.

Figure 4:
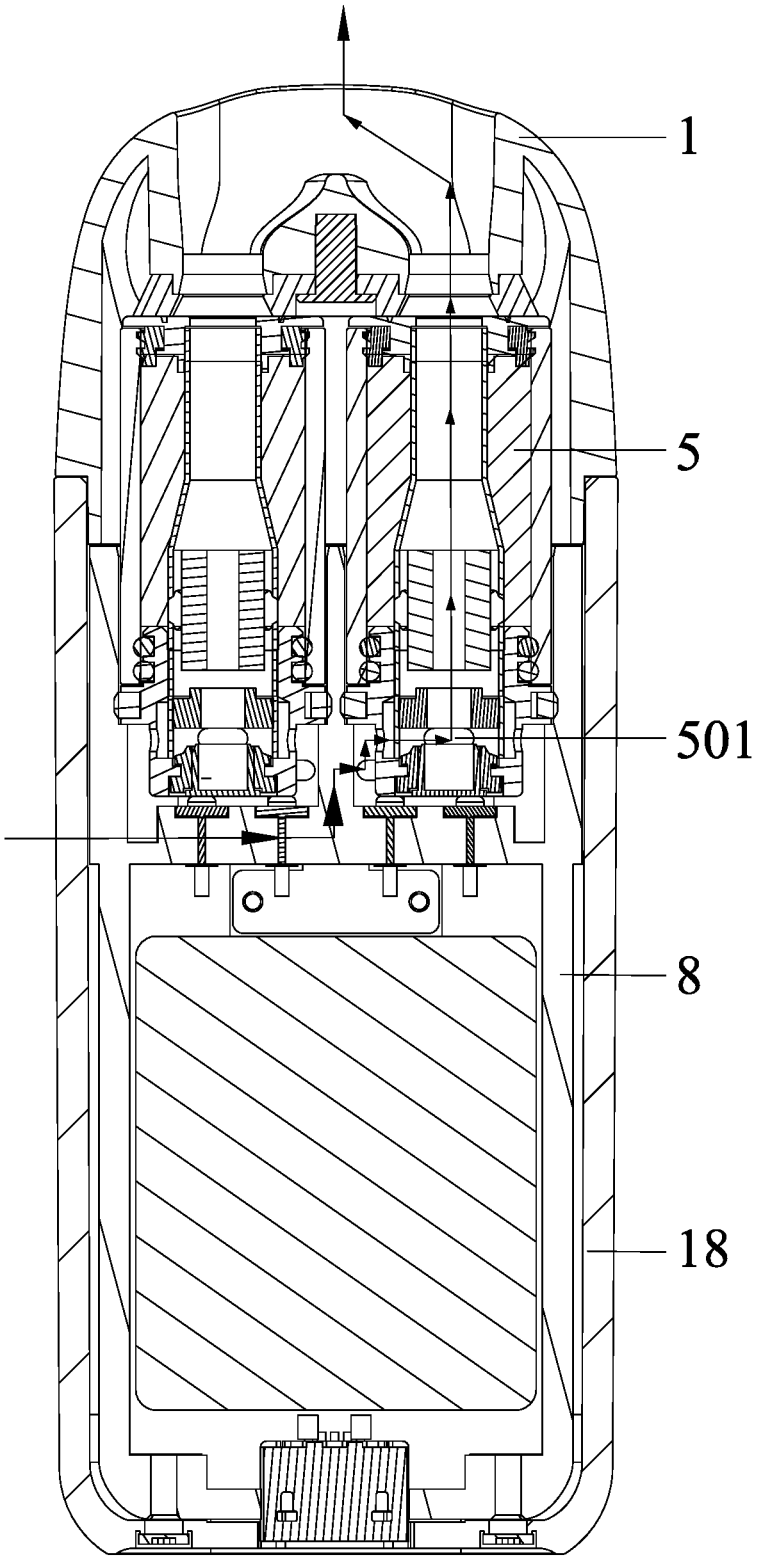
FIG. 4 is across-sectional view showing the direction of smoke and airflow in an electronic cigarette according to one embodiment of the disclosure.

FIG. 4 is a cross-sectional view including arrows showing the direction of airflow and smoke in the electronic cigarette of the disclosure. The external air flows through the through hole 108, into the two air inlets 801, through the air holes 501 into the airflow channel of the two clearomizers 5; then the air flow drives the smoke generated from the two clearomizers 5 to flow through the mouthpiece 1, allowing the smoke to be inhaled by a user.

In the electronic cigarette of the disclosure, the magnetic members are disposed on the sliding member to slide left and right with respect to the main body. The magnetism of the magnetic member leads to a change in the potential difference of the output circuit that controls the two clearomizers to work independently or together; the sliding member is moved left and right to control the amount of the smoke and the air from the two clearomizers; the two clearomizers are independently disposed in the different chambers, which allows for more convenient replacement of the two clearomizers, as compared to the related art.

Example 2

The electronic cigarette of the example is substantially similar to the corresponding electronic cigarette of the embodiment, except that there are no magnetic members and the semiconductor switches in the electronic cigarette. A pneumatic switch is disposed in the airflow channel or the air hole of each of the two clearomizer 5. The pneumatic switch is electrically connected to a conductive element and the control board 12, respectively. The conductive member is disposed on the surface of each of the two clearomizers 5 that is opposite to the surface of the control board 12. The conductive element is directly electrically connected to an electronic component of the control board 12, without affecting the detachable connection of the two clearomizers 5. The conductive element comprises a conductive metal.

When the sliding member 10 is moved to the left, the left air inlet 801 is covered, causing the left air hole 501 to be covered as well; the left pneumatic switch cannot sense the airflow through the left clearomizer 5 and thus stops operating; while the right pneumatic switch can sense the airflow through the right clearomizer and thus operates normally. When the sliding member 10 is moved to the right, the right air inlet 801 is covered, causing the right air hole 501 to be covered as well; the right pneumatic switch cannot sense the airflow through the right clearomizer 5 and thus stops operating; while the left pneumatic switch can sense the airflow through the left clearomizer and thus operates normally. When the sliding member is moved to a middle position of the sliding groove 802, the two air inlets 801 still allow the air to pass, enabling the pneumatic switches to sense airflow and work together.

It will be obvious to those skilled in the art that changes and modifications may be made, and therefore, the aim in the appended claims is to cover all such changes and modifications.

What is claimed is:

1. An electronic cigarette, comprising a main body, a control assembly, two clearomizers, and a sliding member; wherein:

the two clearomizers and the sliding member are disposed on the main body;

the sliding member is slidable along a movement line on the main body to drive the control assembly to control operations of the two clearomizers;

each of the two clearomizers comprises an air hole;

the main body comprises two air inlets, each of the two air inlets communicating with one air hole;

the two air inlets are disposed along the movement line;

the sliding member is configured to slide to cover and/or expose the two air inlets;

the control assembly comprises a control board, two semiconductor switches, and two magnetic members;

the two semiconductor switches are disposed on the control board along the movement line, and abut against the sliding member;

the two magnetic members are disposed on the sliding member along the movement line; and the sliding member is configured to slide along the movement line towards one semiconductor switch, whereby one magnetic member is disposed above the one semiconductor switch, magnetism of the one magnetic member causes a change in a potential difference of the one semiconductor switch, and the one semiconductor switch is turned off to prevent the operation of one clearomizer.

2. The electronic cigarette of claim 1, wherein the main body further comprises a first housing comprising two chambers configured to accommodate the two clearomizers respectively.

3. The electronic cigarette of claim 2, wherein the first housing comprises a sliding groove; the sliding member is disposed in the sliding groove to slide back and forth within the sliding groove; the two air inlets are disposed on a wall of the sliding groove; the main body further comprises a second housing disposed outside of the first housing; the second housing comprises a through hole matched with the sliding groove; the sliding member is disposed through the through hole or a slide switch is disposed in the through hole to connect to the sliding member.

4. The electronic cigarette of claim 1, wherein each of the two clearomizers comprises an airflow channel, and the control assembly further comprises a pneumatic switch disposed in the airflow channel or in the air hole.

5. The electronic cigarette of claim 1, wherein each of the two clearomizers comprises an electrical heating element, and resistances of electrical heating elements of the two clearomizers are different from each other.

6. The electronic cigarette of claim 1, wherein a mouthpiece is disposed on the main body and communicates with each of the two clearomizers; the mouthpiece is detachably connected to the main body and the two clearomizers are detachably disposed in the main body.

* * * * *